United States Patent [19]

Franko

[11] 4,351,606

[45] Sep. 28, 1982

[54] VARIABLE MAGNIFICATION OPTICAL SYSTEM FOR USE IN ELECTROPHOTOGRAPHIC PRINTING

[75] Inventor: Eugene B. Franko, Marion, N.Y.

[73] Assignee: Xerox Corporation, Stamford, Conn.

[21] Appl. No.: 237,031

[22] Filed: Feb. 23, 1981

[51] Int. Cl.[3] ..... G03G 15/00

[52] U.S. Cl. ..... 355/14 R; 355/55

[58] Field of Search ..... 355/14 R, 55–58, 355/60

[56] References Cited

U.S. PATENT DOCUMENTS 3,944,356 3/1976 Hayne ..... 355/3 R
4,211,482 7/1980 Arai et al. ..... 355/8
4,272,187 6/1981 Birdsall et al. ..... 355/56
4,277,163 7/1981 Ikesue et al. ..... 355/14 R

*Primary Examiner*—Richard L. Moses

[57] ABSTRACT

An electrophotographic printing method and apparatus in which a variable magnification optical system adjusts the size of indicia being reproduced on a copy sheet from a document. The size of the surface area of the copy sheet is compared with the surface area of the document being reproduced to generate a signal indicative of the difference therebetween. Responsive to this signal, the platens supporting the document and a lens are moved in synchronism relative to the photoconductive member to adjust the magnification of the indicia being reproduced.

5 Claims, 3 Drawing Figures

VARIABLE MAGNIFICATION OPTICAL SYSTEM FOR USE IN ELECTROPHOTOGRAPHIC PRINTING

This invention relates generally to a variable magnification optical system. An optical system of this type is frequently employed in an electrophotographic printing machine.

Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the indicia contained on the original document. After recording the electrostatic latent image on the photoconductive member, the latent image is developed by bringing a developer mixture into contact therewith. This forms a powder image on the photoconductive member which is subsequently transferred to a copy sheet. Finally, the copy sheet is heated to permanently affix the powder image thereto in image configuration.

The electrophotographic printing machine is generally capable of producing a copy that corresponds at a 1:1 magnification ratio with respect to the original document. In addition, the copies produced by the printing machine may be reduced or magnified in size from the original document. However, there is no assurance that the information contained in the original document will be capable of fitting on the copy sheet for the desired magnification or reduction selected by the operator.

Various approaches have been devised to vary the magnification of an electrophotographic printing machine. The following disclosures appear to be relevant:

U.S. Pat. No. 3,556,655
Patentee: Lux et al.
Issued: Jan. 19, 1971

U.S. Pat. No. 3,687,544
Patentee: Muller
Issued: Aug. 29, 1972

U.S. Pat. No. 3,703,334
Patentee: Knechtel et al.
Issued: Nov. 21, 1972

U.S. Pat. No. 3,778,147
Patentee: Reehil et al.
Issued: Dec. 11, 1973

U.S. Pat. No. 3,944,356
Patentee: Hayne
Issued: Mar. 16, 1976

U.S. Pat. No. 4,118,118
Patentee: Barto, Jr.
Issued: Oct. 3, 1978

U.S. Pat. No. 4,211,482
Patentee: Arai et al.
Issued: July 8, 1960

The pertinent portions of the foregoing disclosures may be briefly summarized as follows:

Lux et al. discloses an electrophotographic printing machine having a turret lens assembly for projecting a full size or reduced size image on the charged photoconductive copy sheet.

In Muller, the magnification of the electrophotographic printing machine is adjusted by moving the lens and mirror reflecting the light rays transmitted from the original document therethrough.

Knechtel et al. ('334) describes an optical system comprising a pair of mirrors. One mirror is operable to achieve a first magnification with the other mirror being operable to achieve a second magnification. A lens is selectively movable to focus the light image from the operable mirror onto the photosensitive member.

Reehil et al. discloses an electrophotographic printing machine having a movable lens to vary the magnification of the optical system. Magnification ratios are selected manually.

In Hayne, the surface area of the copy sheet is sensed. The charged area of the photoconductive surface is controlled to correspond to the sensed surface area of the copy sheet.

Barto, Jr. discloses an electrophotographic printing machine in which the optical system includes a retractible auxiliary lens arranged to be placed in front of the lens to adjust the magnification. The position of the image mirror relative to the photoconductive drum is shifted to focus the image on the drum. The scan velocity is adjusted to a value appropriate for the selected magnification ratio.

Arai et al. discloses an electrophotographic printing machine in which movement of the scanning system is controlled by the detected copy paper size and copying magnification to correspond to the area available for copying on the original platform.

Other patents which relate to variable magnification optical systems are; U.S. Pat. No. 3,779,642 issued to Ogawa et al. in 1973, U.S. Pat. No. 3,792,926 issued to Knechtel et al. in 1974, U.S. Pat. No. 3,806,241 issued to Gregg et al. in 1974, U.S. Pat. No. 3,829,209 issued to Buddendeck et al. in 1974, U.S. Pat. No. 3,827,803 issued to Shelffo et al. in 1974, U.S. Pat. No. 4,046,467 issued to Laskowski et al. in 1977, U.S. Pat. No. 4,057,341 issued to Sohm in 1977, U.S. Pat. No. 4,076,417 issued to Hayashi et al. in 1978, U.S. Pat. No. 4,120,578 issued to Daniels et al. in 1978, U.S. Pat. No. 4,162,845 issued to Smith et al. in 1979, U.S. Pat. No. 4,209,248 issued to Gibson et al. in 1980, and U.S. Pat. No. 4,217,052 issued to Tani et al. in 1980. Knechtel ('241) teaches the use of pushbuttons to select predetermined copy sizes. Gibson et al. and Daniels et al. disclose operator actuated controls for energizing a motor to position the optical system at the desired magnification. The other patents illustrate various types of combinations of copy sheet magnification selection on a semi-automatic basis.

In accordance with the present invention, there is provided an electrophotographic printing machine of the type having a variable magnification optical system for adjusting size of indicia being reproduced on a copy sheet from a document. Means are provided for comparing the size of the surface area of the copy sheet with the surface area of the document and generating a signal indicative of the difference therebetween. Means, responsive to the signal, control the optical system to adjust the magnification so as to reproduce the indicia of the document on the copy sheet.

Other aspects of the present invention will be apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
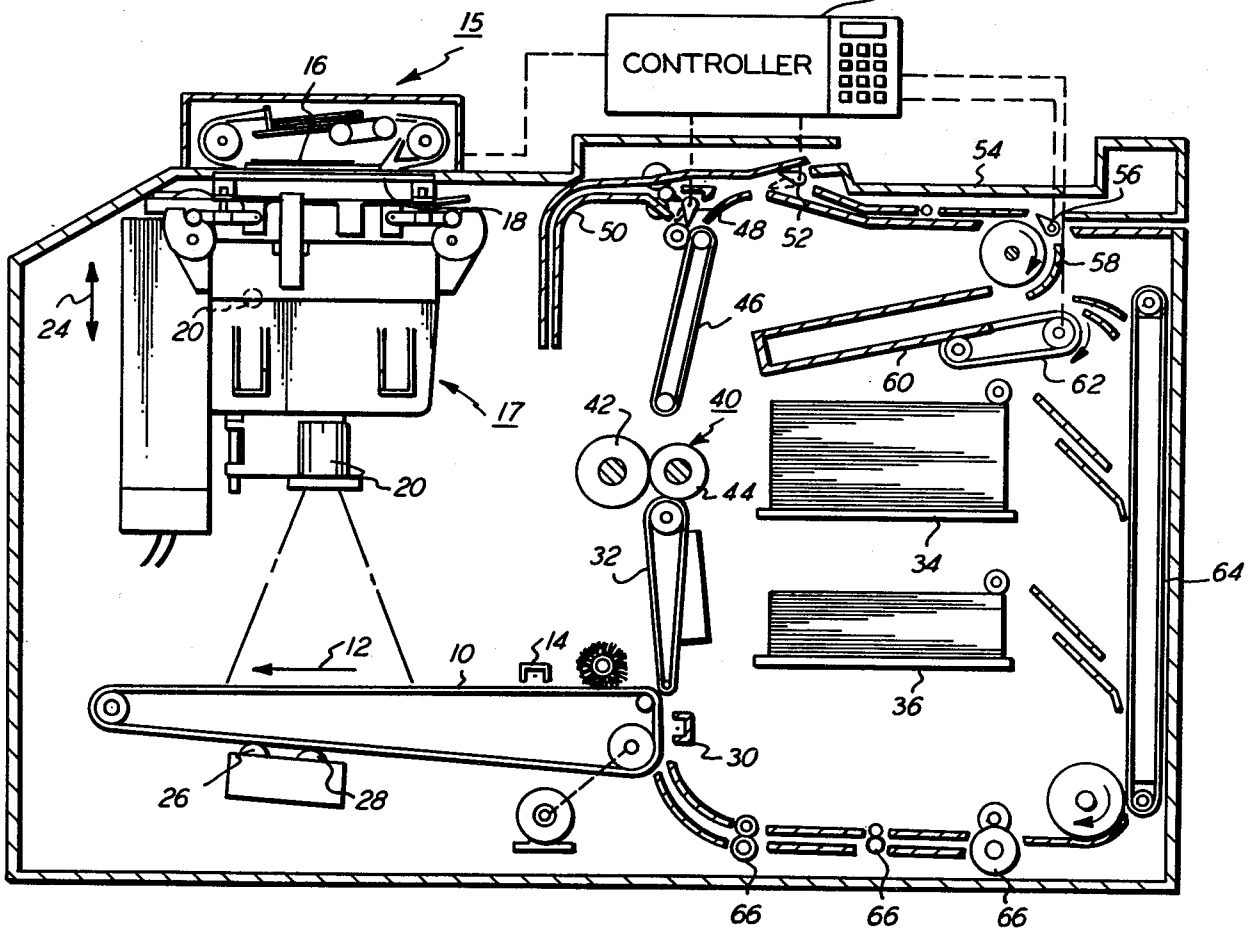
FIG. 1 is a schematic elevational view showing an electrophotographic printing machine employing the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the variable magnification optical system of the present invention therein. It will become evident from the following discussion that the optical system is equally well suited for use in a wide variety of printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit, indicated generally by the reference numeral 15, positions original document 16 facedown over exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portion of the photoconductive surface of belt 10. The details of the imaging system will be described hereinafter with reference to FIG. 2.

Document handling unit 15 sequentially feeds documents from a stack of documents placed by the operator in a normal forward collated order in a document stacking and holding tray. The documents are fed from the holding tray, in seriatim, to platen 18. The document handling unit recirculates documents back to the stack supported on the tray. Preferably, the document handling unit is adapted to serially feed the documents, which may be of various sizes and weights of paper or plastic containing information to be copied. The size of the original document disposed in the holding tray and the size of the copy sheet are measured. Magnification of the imaging system is adjusted to insure that the indicia or information contained on the original document is reproduced within the space of the copy sheet. The details of the control system for adjusting the imaging systems magnification are described, in greater detail, in FIG. 3.

While a document handling unit has been described, one skilled in the art will appreciate that the size of the original document may be measured at the platen rather than in the document handling unit. This is required for a printing machine which does not include a document handling unit.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from a selected one of trays 34 or 36 to transfer station D. Each of these trays sense the size of the copy sheet and send an electrical signal indicative thereof to a microprocessor 80 (FIG. 3) within controller 38. Similarly, the holding tray of document handling unit 15 includes switches thereon which detect the size of the original document and generate an electrical signal indicative thereof which is transmitted also to microprocessor 80 (FIG. 3) of controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, conveyor 46 transports the sheets to gate 48 which functions as an inverter selector. Depending upon the position of gate 48, the copy sheets will either be deflected onto a sheet inverter 50 or bypass sheet inverter 50 and be fed directly onto a second decision gate 52. Thus, copy sheets which bypass inverter 50 turn a 90° corner in the sheet path before reaching gate 52. Gate 52 inverts the sheets into a faceup orientation so that the imaged side which has been transferred and fused is faceup. If inverter path 50 is selected, the opposite is true, i.e. the last printed face is facedown. Second decision gate 52 deflects the sheet directly into an output tray 54 or deflects the sheet into a transport path which carries them on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e. the copy sheets being duplexed. Due to the sheet inverting by rollers 58, these buffer set sheets are stacked in duplex tray 60 facedown. They are stacked in duplex tray 60 on top of one another in the order in which they are copied.

In order to complete duplex copying, the previously simplexed sheets in tray 60 are fed seriatim by bottom feeder 62 back to transfer station D for transfer of the toner powder image to the opposed side of the sheet. Conveyors 64 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with the photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
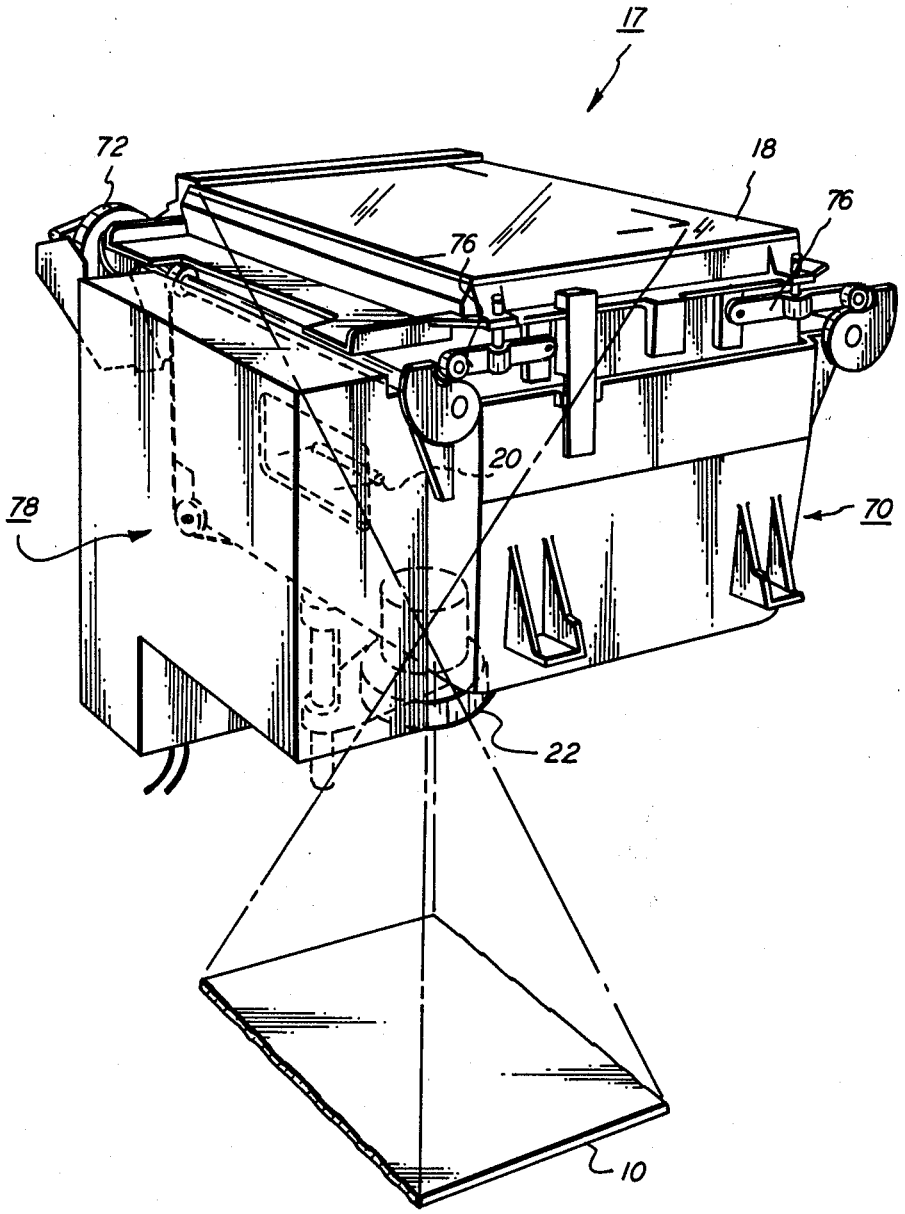
FIG. 2 is a schematic perspective view depicting the optical system used in the FIG. 1 printing machine.

Referring now to the specific subject matter of the present invention, the general operation of the exposure system 17 will be described hereinafter with reference to FIG. 2. The magnification control system of the exposure system 17 may be characterized as a relative position automatic control system using a reversable AC motor, digital feedback encoder, and microprocessor controller to position the platen and lens so as to achieve the correct magnification and focus of images. The location of the platen and lens is controlled by cams, a band drive and a cable attached to a capstan directly coupled to the output drive shaft of the motor. Platen 18 is positioned on top of integrated cavity 70. Drive motor 72 is coupled to cams 74. As drive motor 72 rotate, cams 74 rotate in conjunction therewith. Rotation of cams 74 move cam followers 76. Cam followers 76 are secured to platen 18. In this manner, platen 18 is translated so as to vary the magnification of the original document being reproduced. Movement of platen 18 is controlled by the rotation of cams 74 having cam followers 76 riding thereon. Cam followers 76 are directly coupled to platen 18. Thus, any movement of cam followers 76 is directly transmitted to platen 18. Platen 18 is translated in a bidirectional manner. In one direction, the optical image is magnified with the optical image being reduced by movement in the other direction. The cam drive and cable system, indicated generally by the reference numeral 78, is attached to a capstan directly coupled to the output drive shaft of motor 72. This system is also connected to lens 22. Thus, any rotation of motor 72 moves lens 22. In this manner, motor 72 drives both platen 18 and lens 22 in synchronism so as to focus the image which may be magnified or reduced in size onto the photoconductive surface of belt 10. Preferably, drive motor 72 is a reversable permanent capacitor AC induction gear motor. The rotor speed is normally 3200 rpm and the output speed is 10 rpm. The microprocessor of controller 38 turns drive motor 72 on and off in either the forward or reverse phase causing the output shaft to rotate and position the platen 18 and lens 22 in accordance with the desired magnification.

Figure 3:
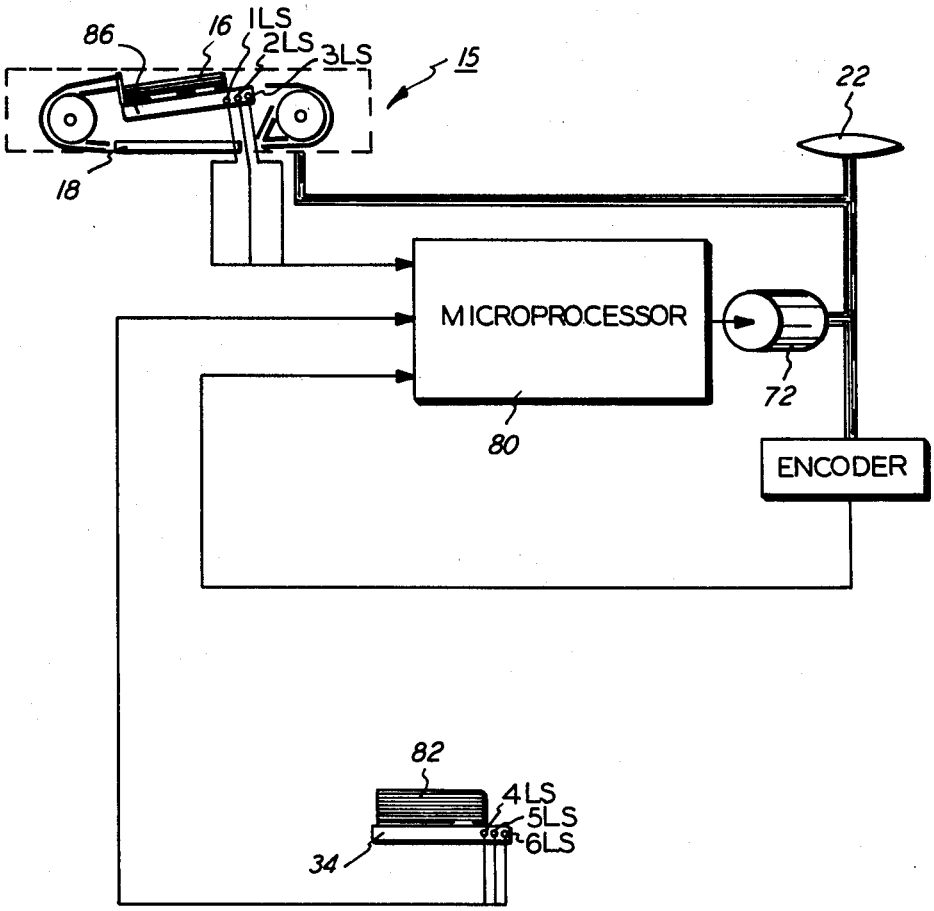
FIG. 3 is a schematic elevational view illustrating the interaction between the copy sheet and original document in controlling the magnification of the optical system of FIG. 2.

Turning now to FIG. 3, there is shown the detailed arrangement for controlling the magnification so as to insure that the indicia on the original document are reproduced on the copy sheet. As shown thereat, document handling unit 15 includes a holding tray 86 which has original document 16 disposed thereon. Holding tray 86 has a plurality of switches. In particular, there are shown three switches associated therewith, 1LS, 2LS, and 3LS, respectively. Switches 1LS, 2LS and 3LS are activated by differing lengths of original documents 16. By way of example, an 8½ inch long original document will activate switch 1LS while an 11 inch original document will energize switches 1LS and 2LS, and a 14 inch original document will energize switches 1LS, 2LS and 3LS. The signals from switches 1LS, 2LS and 3LS are transmitted to microprocessor 80 of controller 38. In a similar manner, trays 34 and 36 include a plurality of switches thereon for measuring the size of the copy sheets. Inasmuch as trays 34 and 36 are identical with one another, only one tray will be described hereinafter. Thus, only tray 34 will be discussed. As shown in FIG. 3, tray 34 includes a plurality of switches 4LS, 5LS and 6LS. Switches 4LS, 5LS and 6LS are activated by differing lengths of stacks of copy sheets 82. By way of example, an 8½ inch long stack of copy paper will activate switch 4LS with an 11 inch stack of copy paper energizing switches 4LS and 5LS and a 14 inch stack of copy paper energizing switches 4LS, 5LS and 6LS. The electrical output signals from switches 4LS, 5LS and 6LS are processed by microprocessor 80.

Microprocessor 80 compares the signal indicative of the length of original document 16 with the signal indicative of the length of copy sheet 82. The difference therebetween is employed to drive motor 72.

At initiation of power-on, or at the appropriate command, drive motor 72 will axially drive lens 22 and platen 18 to the home positions, which are physically established by activating a micro-switch or similar detecting device. Thereafter, motor 72 will rotate and each pulse will be counted. The count relative to home position will be compared to numbers stored in the memory register of microprocessor 80 for the desired magnification. The number stored in the memory register of microprocessor 80 is determined by the difference between the signal indicating the size of original document 16 and that of copy sheet 82. When the count equals the stored number, the motor will stop and the lens and platen will be properly positioned so as to insure that the indicia recorded on original document 16 are reproduced on copy sheet 82. The count will be retained within microprocessor 82 so that for the next required magnification, it is compared to the required stored number. The positive/negative aspect of the differences between the count and the stored number determine the direction of rotation of motor 72. Motor 72 is coupled to encoder 84. Encoder 84 divides the angular rotation of motor 72 into 535 equal steps through a total rotation of 180°. Each step will be about one-third of a degree. Because of the non-linearity of magnification with angle, the magnification step sizes will vary from approximately 0.0026x/near the 1x position, to about 0.00001x near the limits of 0.6411x and 1.5598x. Each step will be counted by one pulse of encoder 84. Preferably, encoder 84 is a 50% duty cycle square wave Hall effect generator which is switched by a magnet attached to the shaft of motor 72.

In recapitulation, it is clear that electrical signals are transmitted to the microprocessor of the printing machine control system corresponding to the size of the original document and the size of the copy sheet. The difference in size is measured and a motor actuated in response thereto so as to move both the lens and original document support. In this manner, the magnification of the optical system is adjusted to insure that the indicia on the original document are reproduced on the copy sheet. Rotation of the motor in one direction increases the size of the indicia reproduced on the copy sheet with rotation in the opposite direction reducing the size of the indicia being reproduced on the copy sheet.

It is, therefore, evident that there has been provided in accordance with the present invention, an electrophotographic printing machine which automatically detects the size of both the original document and copy sheet adjust the magnification of the optical system thereof so that the indicia of the original document are reproduced on the copy sheet. The present invention fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An electrophotographic printing machine of the type having a variable magnification optical system for adjusting the size of indicia reproduced on a copy sheet from a document, said printing machine including a photoconductive member having at least a portion of the surface thereof charged, said photoconductive member being in communication with the optical system so that exposure of the charged portion of said photoconductive member records an electrostatic latent image thereon, said optical system including a support for holding the document thereon, a light source for illuminating the document on said support, and a lens positioned to receive the light rays transmitted from the document and focusing the light image thereon onto the charged portion of said photoconductive member, the improvement comprising:

means for comparing the size of the surface area of the copy sheet with the surface area of the document and generating a signal indicative of the difference therebetween, said means for comparing including means for detecting the size of the document and generating a document signal corresponding thereto, means for sensing the size of the copy sheet and generating a copy sheet signal corresponding thereto, and means for measuring the difference between the copy sheet signal and the document signal to be generated; and means, responsive to the signal from said comparing means, for controlling the optical system to adjust the magnification thereof so as to reproduce the indicia of a document on the copy sheet, said controlling means including a motor coupled to said support and said lens so as to move said support and said lens relative to said photoconductive member to adjust the magnification of the indicia being reproduced.

2. A printing machine according to claim 1, wherein said controlling means includes means for determining the angular rotation of said motor and generating a motor signal indicative thereof.

3. A printing machine according to claim 2, wherein logic circuitry compares the error signal with the motor signal to produce an actuating signal controlling the motor angular rotation.

4. A printing machine according to claim 3, wherein the actuating signal drives the motor in one direction to increase the size of the indicia on the copy sheet and in the other direction to reduce the size of the indicia on the copy sheet.

5. A method of reproducing an original document on a copy sheet, comprising the steps of:

supporting the document on a platen;

illuminating the original document;

charging at least a portion of a photoconductive member;

transmitting the light rays from the original document to a lens which focuses the light image thereof onto the charged portion of the photoconductive member;

detecting the size of the original document;

sensing the size of the copy sheet;

measuring the difference between the detected size of the original document and the sensed size of the copy sheet to generate a signal indicative of the difference in size between the surface area of the original document and the surface area of the copy sheet; and moving the platen and lens in synchronism relative to the photoconductive member to adjust the magnification of the optical system in response to the signal so as to reproduce the original document on the copy sheet.

* * * * *